US006754350B2

(12) United States Patent
Sugimoto

(10) Patent No.: US 6,754,350 B2
(45) Date of Patent: Jun. 22, 2004

(54) SURROUND REPRODUCING CIRCUIT

(75) Inventor: Yositugu Sugimoto, Kamifukuoka (JP)

(73) Assignee: New Japan Radio Co., Ind., Tokyo-To (JP)

( * ) Notice: Subject to any disclaimer, the term of this patent is extended or adjusted under 35 U.S.C. 154(b) by 96 days.

(21) Appl. No.: 10/106,091

(22) Filed: Mar. 22, 2002

(65) Prior Publication Data

US 2002/0136412 A1 Sep. 26, 2002

(30) Foreign Application Priority Data

Mar. 22, 2001 (JP) ..... 2001-082355
Dec. 21, 2001 (JP) ..... 2001-389268

(51) Int. Cl.[7] ..... H04R 5/00; H04R 5/02
(52) U.S. Cl. ..... 381/17; 381/18; 381/27; 381/1; 381/307
(58) Field of Search ..... 381/17, 18, 19, 381/1, 2, 307, 27

(56) References Cited

U.S. PATENT DOCUMENTS 5,883,962 A * 3/1999 Hawks ..... 381/1
6,381,333 B1 * 4/2002 Suzuki ..... 381/18
6,504,933 B1 * 1/2003 Chung ..... 381/1

* cited by examiner

*Primary Examiner*—Forester W. Isen
*Assistant Examiner*—Elizabeth McChesney

(57) ABSTRACT

A surround reproducing circuit includes a first adder for generating a difference signal of an L signal and an R signal which are inputted, a low-pass filter connected to an output side of the first adder, and second and third adders for mixing an output signal of the low-pass filter as a surround signal with the L signal and the R signal in an opposite phase relationship to each other. Change in a phase is lessened within a frequency band of 20 Hz to 20 KHz and the localization can become definite, and furthermore, a harsh high pass is also lessened. Consequently, it is possible to realize a surround effect having natural spread. Furthermore, the number of capacitors to be required can also be decreased.

12 Claims, 5 Drawing Sheets

SURROUND REPRODUCING CIRCUIT

BACKGROUND OF THE INVENTION

The present invention relates to a surround reproducing circuit for inputting a stereophonic signal for two channels of an L signal (a left signal) and an R signal (a right signal), thereby producing a surround effect by means of two speakers.

Most of a frequency distribution of a voice which can be heard by a human concentrates in the vicinity of 300 Hz to 3.5 KHz. A frequency of 1 KHz is important to the articulation of a conversation and a wavelength thereof is approximately 30 cm. Accordingly, if the voice arrives from the left in a transverse direction of a head, it reaches a right ear in an opposite phase to a left ear because the right ear is distant by approximately 15 cm as compared with the left ear. More specifically, in the case in which the same sound arrives from the left and the right, a listener feels that an image of sound source is present on the front.

Referring to the L-R signal, however, a change in a phase and a difference between sound volumes are made for the R signal. Therefore, the source of sound of the L-R signal is localized on the left side within a range of 180 degrees so that the human feels that the sound comes from just the left side. Referring to the R-L signal, similarly, the source of sound of the R-L signal is localized on the right side within a range of 180 degrees so that the human feels that the sound comes from just the right side.

On the other hand, in the case in which a sound comes from the front, a voice frequency band (300 Hz to 5 KHz) is emphasized through an earlobe and an ear hole. In the case in which the sound comes from just the side, a frequency characteristic is almost flat.

In order to cause the sound of the L-R signal coming from the front to pretend to be a sound coming from the left side, accordingly, it is necessary to reduce the level of a voice frequency band (300 Hz to 5 KHz) of the L-R signal by a predetermined amount. In order to cause the sound of R-L coming from the front to pretend to be a sound coming from the right side, similarly, it is necessary to reduce the level of the voice frequency band (300 Hz to 5 KHz) of the R-L signal by a predetermined amount.

A conventional surround reproducing circuit having one speaker arranged in each of left and right front portions generates an L side surround signal to be an L-R signal from an L signal and an R signal of a stereo which are inputted from input terminals 21 and 22 by means of an adding circuit 23, and inputs a difference signal to a band-elimination filter 24 having a frequency characteristic of FIG. 9, thereby reducing the level of a voice frequency band (300 Hz to 5 KHz) as shown in FIG. 8.

The gain of the L side surround signal having a frequency characteristic thus regulated is further regulated by means of a gain variable amplifier comprising an operational amplifier 25 and resistors R7 and R8, and is exactly added to an L signal line by means of an adder 26 and is converted into an R side surround signal by phase inversion by means of an adder 27 to be added to an R signal line, and is thus outputted to output terminals 28 and 29. The reference numerals 30, 31, 32 and 33 denote a buffer.

Thus, a voice signal component which is easy to understand a sense of direction emphasized by a human ear is removed and a reverberation sound or an echo sound in a frequency band which is hard to understand the sense of direction is intensified and mixed with the L signal or the R signal to emphasize a change in a phase and a difference between sound volumes. Thus, a surround effect is realized.

FIG. 10 is a diagram showing another conventional surround reproducing circuit, in which a higher order band-elimination filter is constituted by an operational amplifier 34, a parallel circuit of a resistor R9 and a capacitor C3 connected between an output terminal of the operational amplifier 34 and an inversion input terminal, and a series circuit of a resistor R10 and a capacitor C4 connected between the inversion input terminal and a ground. By the band-elimination filter, the level of a voice frequency band (300 Hz to 5 KHz) is reduced in the same manner as in the band-elimination filter 24 in FIG. 8.

In a circuit for using a plurality of filters higher than second order to enhance a surround effect, there is a problem that a change in a phase is increased to make the localization of an image of sound source unclear and to cause a surround having a sense of distortion.

In the conventional surround reproducing circuit shown in FIG. 8, furthermore, at least two capacitors are required for constituting the band-elimination filter 24 and so is a surround reproducing circuit shown in FIG. 10. These capacitors require a generally large capacitance. It is hard to constitute the capacitors in an IC when forming the whole as IC. For this reason, it is necessary to externally attach the capacitors. Therefore, there is a problem that the number of IC pins is increased.

In the conventional surround reproducing circuit shown in FIGS. 8 and 10, furthermore, if an interval between speakers is small, for example, 20 cm or less, the surround signals added in opposite phases to each other through the adders 26 and 27 are offset in a space. Consequently, there is also a problem that a sufficient surround effect cannot be obtained.

It is an object of the present invention to provide a surround reproducing circuit in which a change in a phase is not increased and the localization of a source of sound becomes definite, and furthermore, a filter can be simplified and an excellent surround effect can be obtained even if an interval between speakers is small.

SUMMARY OF THE INVENTION

In accordance with a first aspect of the present invention, there is provided a surround reproducing circuit which includes a first adder for generating a difference signal of an L signal and an R signal which are inputted, a low-pass filter connected to an output side of the first adder, and second and third adders for mixing an output signal of the low-pass filter as a surround signal with the L signal and the R signal in an opposite phase relationship to each other.

In accordance with a second aspect of the present invention, a phase-shifting circuit having an almost constant gain in a full frequency band of the input signal and serving to carry out a phase shift for a change from 0 to 180 degrees according to an increase in a frequency of the input signal is connected to an output side of the second or third adder.

In accordance with a third aspect of the present invention, an amplifier or an attenuator is connected to the output side of the second or third adder and a gain difference between a channel of the L signal and a channel of the R signal is set to be 3 dB or more.

In accordance with a fourth aspect of the present invention, the low-pass filter has a cut-off frequency of 700 Hz to 2 KHz and an attenuation characteristic of −6 dB/oct.

In accordance with a fifth aspect of the present invention, a gain variable amplifier is inserted into an output side of the low-pass filter and an output signal of the gain variable amplifier is inputted to the second and third adders in an opposite phase relationship to each other.

In accordance with a sixth aspect of the present invention, the phase-shifting circuit is replaced with a phase-shifting circuit having an almost constant gain within a full-frequency band of the input signal and serving to carry out a phase shift for a change from 90 to 175 degrees within a frequency band of 300 Hz to 3.5 KHz.

In accordance with a seventh aspect of the present invention, in which the phase-shifting circuit is replaced with a phase-shifting circuit having an almost constant gain within a full-frequency band of the input signal and serving to carry out a phase shift from 120 to 170 degrees at a frequency of 1 KHz.

DETAILED DESCRIPTION

As a result of repeated experiments for a surround effect by using various music sources, there was confirmed that L-R and R-L signal components rarely include a vocal component and only an echo sound is heard. In other words, the L-R and R-L signal components have a little frequency component of 300 Hz or less and mainly include a component of "Sa, Shi, Su, Se, So" having a high frequency of a slight vocal and an echo sound of approximately 5 KHz or less.

Thus, the L-R and R-L signal components rarely include a voice frequency component and mainly include only a high frequency component. Therefore, it could be confirmed that the level of the voice frequency component (300 Hz to 3 KHz) of the L-R and R-L signal components does not need to be greatly reduced.

Moreover, a frequency component of 3 KHz of the L-R or R-L signal includes a harsh signal component. Therefore, it is necessary to remove the same signal component through a filter so as not to influence a signal in the vicinity of 1 KHz of a slightly included vocal band. However, an echo sound having a frequency of approximately 3 KHz or less is attenuated and lessened through the low-pass filter having a cut-off frequency of 900 Hz and a sharp attenuation characteristic of −12 dB/oct or more. Consequently, it is impossible to obtain a sufficient surround effect.

In order to reduce an attenuation amount from approximately −6 dB to −12 dB at a frequency of 3 KHz, a low-pass filter having a cut-off frequency of 700 Hz to 2 KHz and a gentle attenuation characteristic of −6 dB/oct was used. The attenuation amount of the frequency of 3 KHz is approximately −6 dB with a low-pass filter having a cut-off frequency of 2 KHz, is −10 dB with a low-pass filter having a cut-off frequency of 900 Hz, and is −12 dB with a low-pass filter having a cut-off frequency of 700 Hz.

A desirable surround effect could be obtained by any of the low-pass filters. By using a low-pass filter having a cut-off frequency of 900 Hz and a gentle attenuation characteristic of −6 dB/oct, particularly, a change in a phase is lessened within a frequency band of 20 Hz to 20 KHz and the localization becomes definite, and furthermore, a harsh high-pass component is lessened. Consequently, a surround effect having a natural sense of spread could be realized.

Moreover, the low-pass filter having a cut-off frequency of 900 Hz and a gentle attenuation characteristic of −6 dB/oct can be constituted by one resistor and one capacitor. Consequently, the number of capacitors can be decreased as compared with the case in which a plurality of conventional filters of higher than second order are used.

FIRST EMBODIMENT

Figure 1:
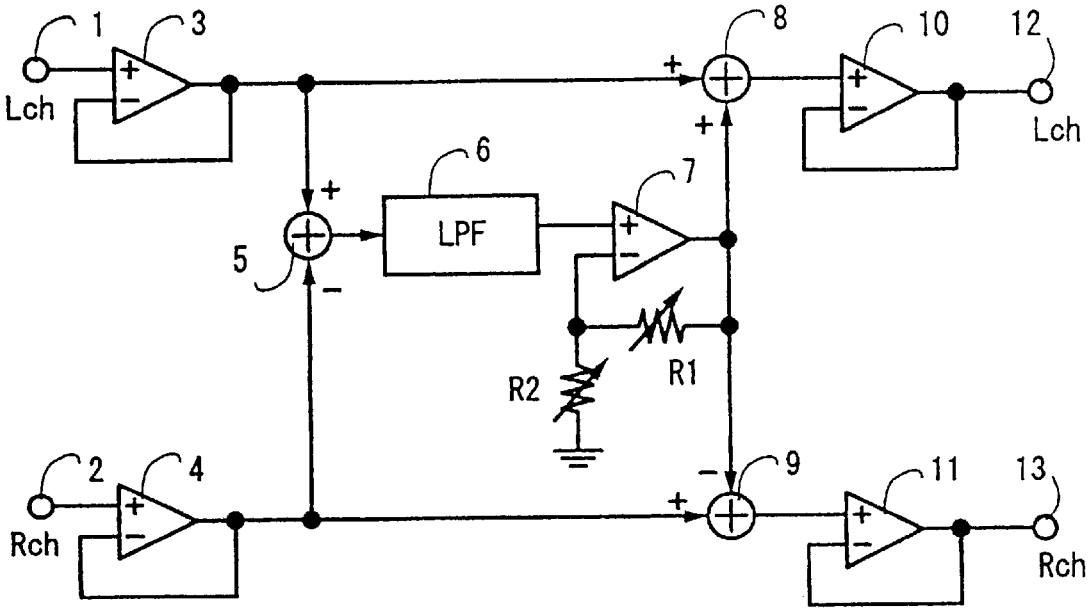
FIG. 1 is a circuit diagram of a surround reproducing circuit according to a first embodiment of the present invention.

FIG. 1 is a diagram showing a surround reproducing circuit according to a first embodiment of the present invention which is constituted in consideration of the above-mentioned respects. The reference numeral 1 denotes an L signal input terminal, the reference numeral 2 denotes an R signal input terminal, the reference numerals 3 and 4 denote buffers, the reference numeral 5 denotes an adder for generating an L-R signal, the reference numeral 6 denotes a low-pass filter having a cut-off frequency of 900 Hz and a gentle attenuation characteristic of −6 dB/oct, the reference numeral 7 denotes an operational amplifier constituting a variable gain amplifier together with resistors R1 and R2, the reference numerals 8 and 9 denote adders, the reference numerals 10 and 11 denote buffers, the reference numeral 12 denotes an L signal output terminal, and the reference numeral 13 denotes an R signal output terminal.

The adder 5 carries out a processing of subtracting an R signal from an L signal and removes a signal component for localizing an image of sound source on a center, thereby extracting a surround signal component on an L side. An L-R signal component thus obtained has a little low frequency component of 300 Hz or less and mainly includes a component of "Sa, Shi, Su, Se, So" having a high frequency of a slight vocal and an echo sound.

Figure 2:
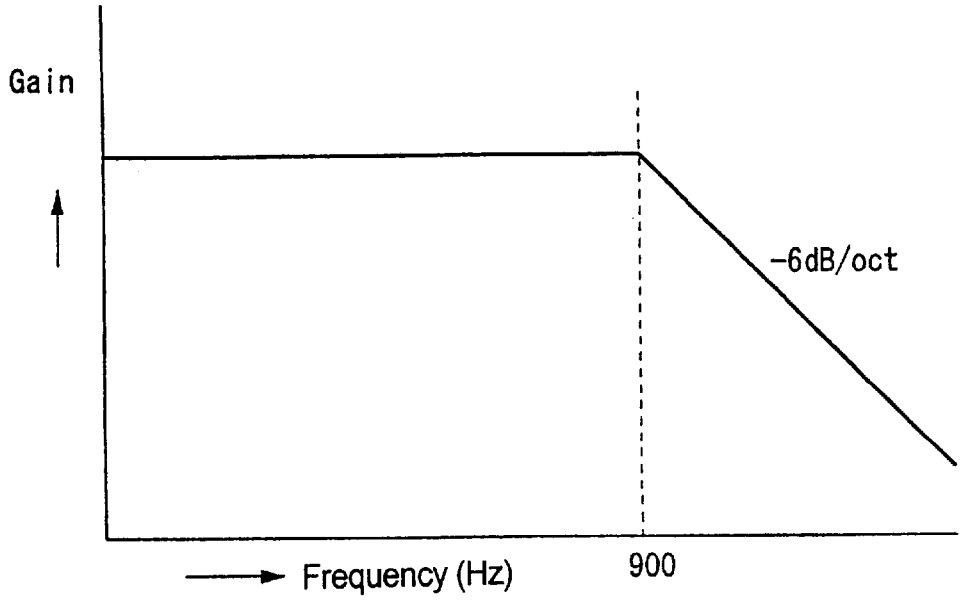
FIG. 2 is a frequency characteristic chart of a low-pass filter in FIG. 1.

The signal component is inputted to the low-pass filter 6 to remove a high-pass component having a frequency of more than 900 Hz. Although a frequency component of 3 KHz or more in the L-R signal component has a harsh signal component, the same signal component is removed by means of the low-pass filter 6. As shown in FIG. 2, the low-pass filter 6 has a cut-off frequency of 900 Hz and a gentle attenuation characteristic of −6 dB/oct. Therefore, a signal in the vicinity of 1 KHz to be a vocal band is not greatly influenced.

The variable gain amplifier constituted by the operational amplifier 7 and the resistors R1 and R2 regulates a gain of the L-R signal component to be outputted from the low-pass filter 6. At this time, at least one of values of the resistors R1 and R2 is varied. Consequently, when the L-R signal component is added as an L side surround signal to an original L signal and the L-R signal component is inverted and added as an R side surround signal to an original R signal, an amount of the addition can be regulated.

Figure 3:
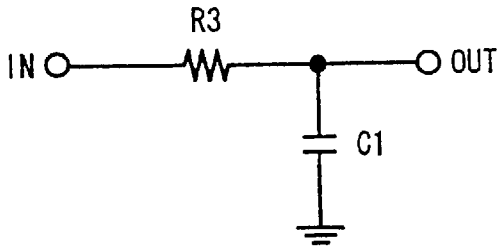
FIG. 3 is a circuit diagram of the low-pass filter in FIG. 1.

The low-pass filter 6 can be constituted by one resistor R3 and one capacitor C1 as shown in FIG. 3. Thus, the low-pass filter 6 can be constituted by one capacitor. However, since a capacitance value is increased, the low-pass filter 6 is externally attached to an IC when forming the whole as IC. In this case, only one IC pin is additionally provided. The low-pass filter can also be constituted by using a gm amplifier having a high output impedance to utilize a capacitor having a low capacitance. However, there is a possibility that S/N might be deteriorated if a capacitor is fabricated in the IC to constitute the low-pass filter. Therefore, the external attachment is preferred.

While the low-pass filter 6 has a cut-off frequency of 900 Hz and a gentle attenuation characteristic of −6 dB/oct in the embodiment described above, it is possible to obtain a desirable surround effect if the cut-off frequency ranges from 700 Hz to 2 KHz.

Moreover, while the L-R signal is fetched from the adder 5, an R-L signal might fetched. In this case, it is preferable that a phase of the R-L signal should be inverted and added to the original L signal by means of the adder 8 and should be added in an exact phase to the original R signal by means of the adder 9.

SECOND EMBODIMENT

The following facts were confirmed. More specifically, if a gain difference between both channels is almost constant within a full frequency range of an input signal and a phase can be shifted from 0 to 180 degrees between both channels according to an increase in a frequency, an image of sound source can be localized on the front. In particular, if a phase difference ranges from 90 to 175 degrees within a frequency band of 300 Hz to 3.5 KHz (90 degrees with 300 Hz and 175 degrees with 3.5 KHz), an image of sound source can be localized on the front. Furthermore, if a phase shift amount has a phase difference of 120 to 170 degrees between both channels at a frequency of 1 KHz, an image of sound source can be localized well so that a stereophonic effect having a sense of spread can be obtained. Moreover, it was confirmed that the sense of spread was eliminated if a phase difference was less than 120 degrees at a frequency in the vicinity of 1 KHz and that an image of sound source is localized in one direction if the phase difference was more than 170 degrees.

Figure 4:
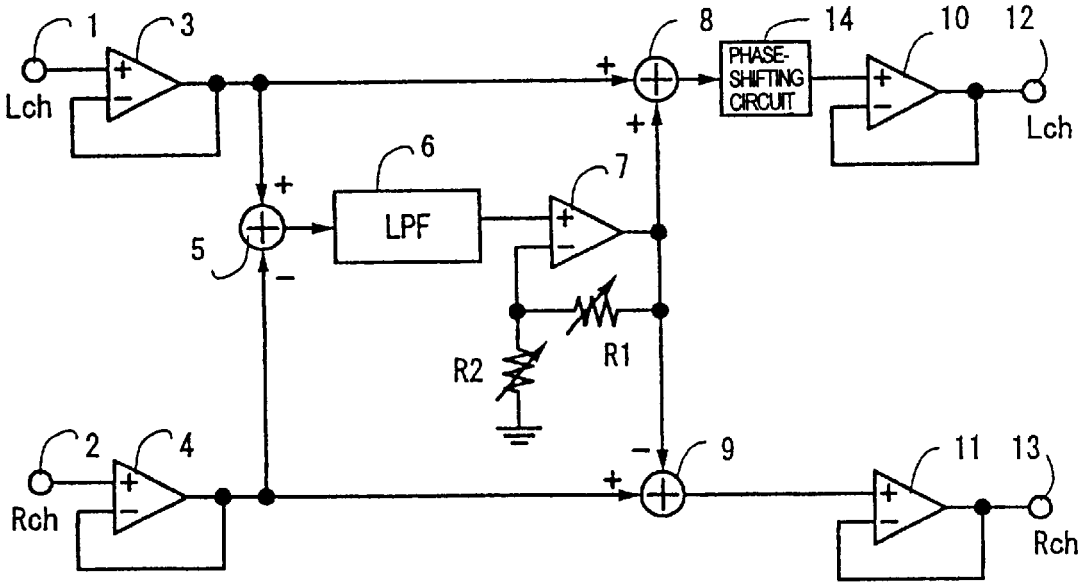
FIG. 4 is a circuit diagram of a surround reproducing circuit according to a second embodiment of the present invention.

FIG. 4 is a block diagram showing a surround circuit according to a second embodiment of the present invention which is constituted in consideration of the above-mentioned respects. The same portions as those of the surround circuit shown in FIG. 1 have the same reference numerals. In the present embodiment, a phase-shifting circuit 14 for a phase shift is inserted between the adder 8 and the buffer 10.

Figure 5:
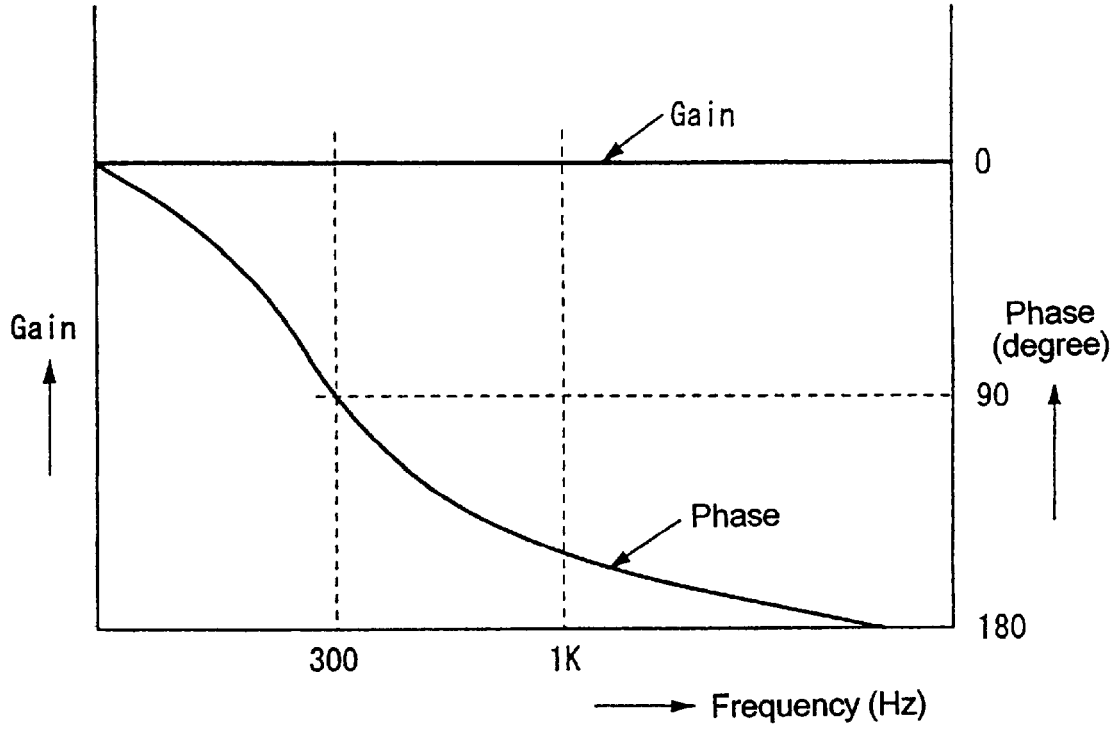
FIG. 5 is a frequency characteristic chart for a phase and gain of a phase-shifting circuit in FIG. 4.
Figure 6:
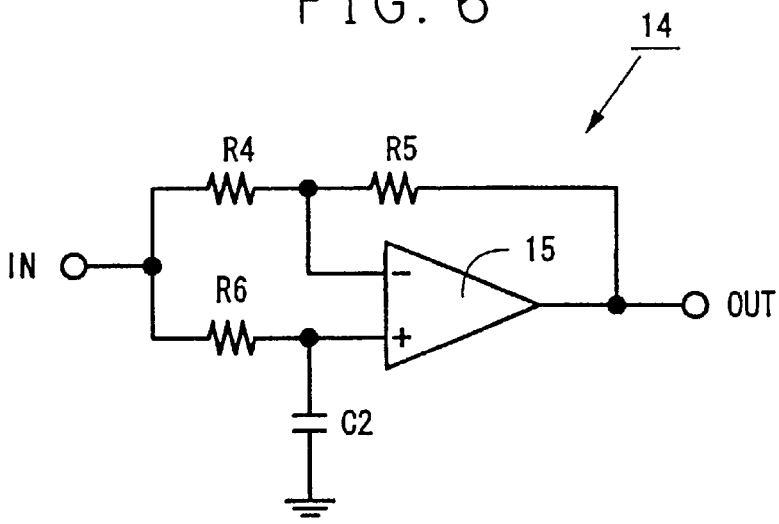
FIG. 6 is a circuit diagram of the phase-shifting circuit in FIG. 4.

FIG. 5 is a frequency characteristic chart for a gain and a phase in the phase-shifting circuit 14, in which the characteristic is determined based on the results of the confirmation. The gain is almost constant within a full frequency range and the phase is shifted for a change from 0 to 180 degrees according to an increase in a frequency, and particularly, the phase is shifted by 90 degrees at a frequency of 300 Hz. The phase shift for a change from 90 to 175 degrees is carried out within a frequency band of 300 Hz to 3.5 KHz. Above all, the phase shift for a change from 120 to 170 degrees (for example, 147 degrees) is carried out at a frequency of 1 KHz. FIG. 6 is a circuit diagram showing the internal structure of the phase-shifting circuit 14 which is constituted by resistors R4 to R6, a capacitor C2 and an operational amplifier 15.

The phase-shifting circuit 14 having the frequency characteristic shown in FIG. 5 is inserted in an L channel to further enhance a surround effect. Consequently, a sufficient surround effect can be produced by speakers which are arranged at a small interval of approximately 20 cm. The phase-shifting circuit 14 can also be inserted into the R channel side.

THIRD EMBODIMENT

Figure 7:
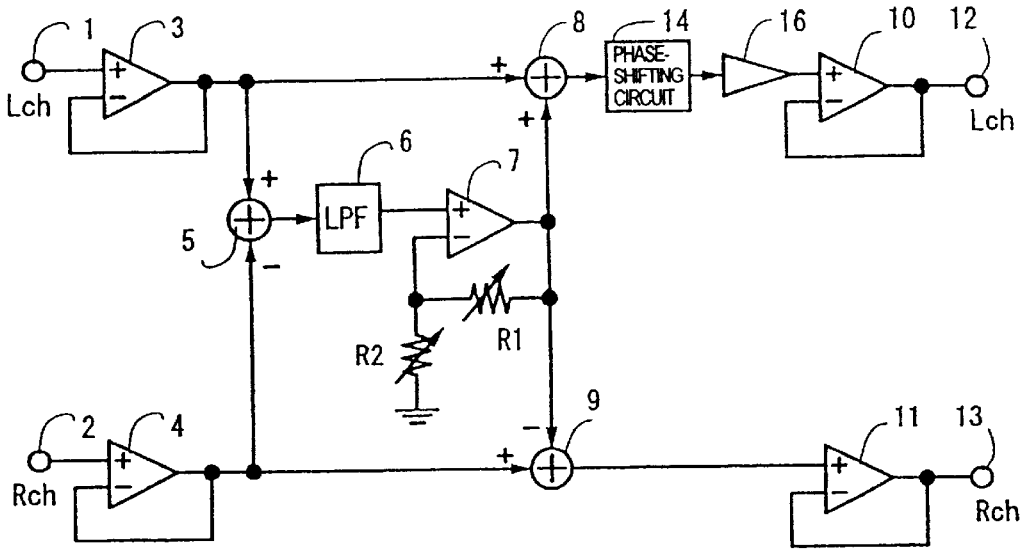
FIG. 7 is a circuit diagram of a surround reproducing circuit according to a third embodiment of the present invention.
Figure 8:
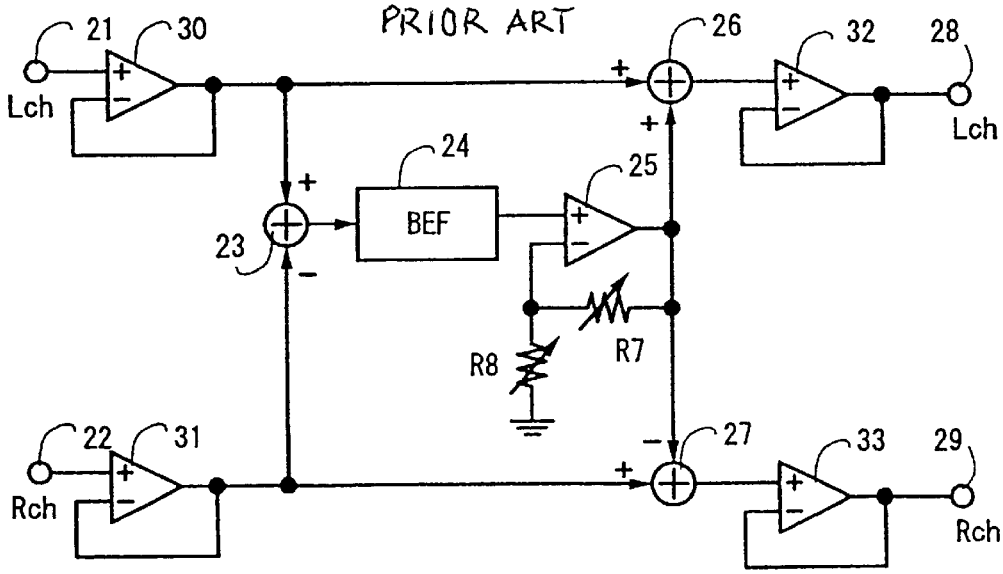
FIG. 8 PRIOR ART
FIG. 8 is a circuit diagram of a conventional surround reproducing circuit.
Figure 9:
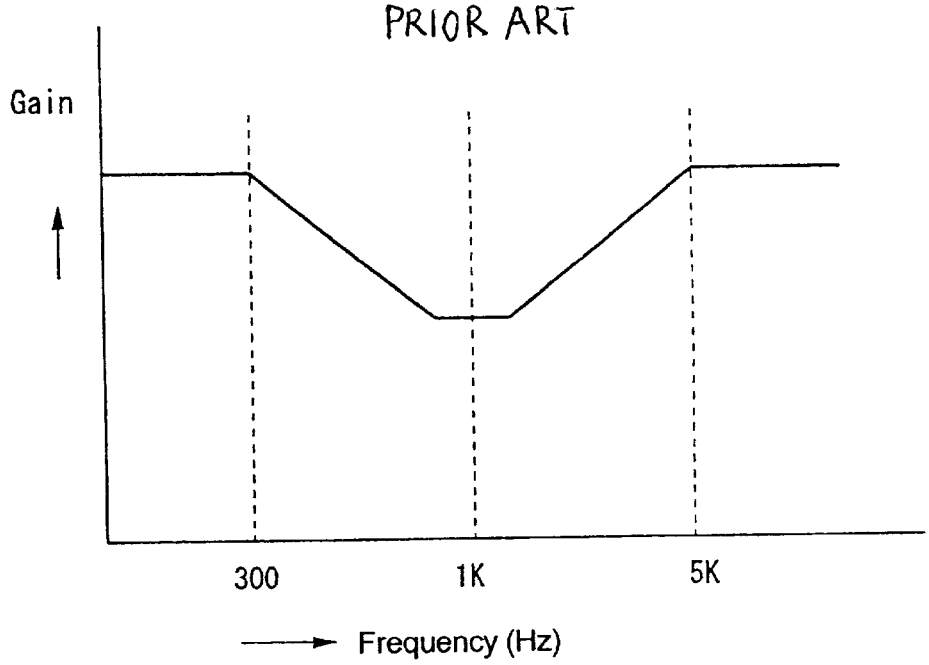
FIG. 9 PRIOR ART
FIG. 9 is a frequency characteristic chart for a band-elimination filter in FIG. 8.
Figure 10:
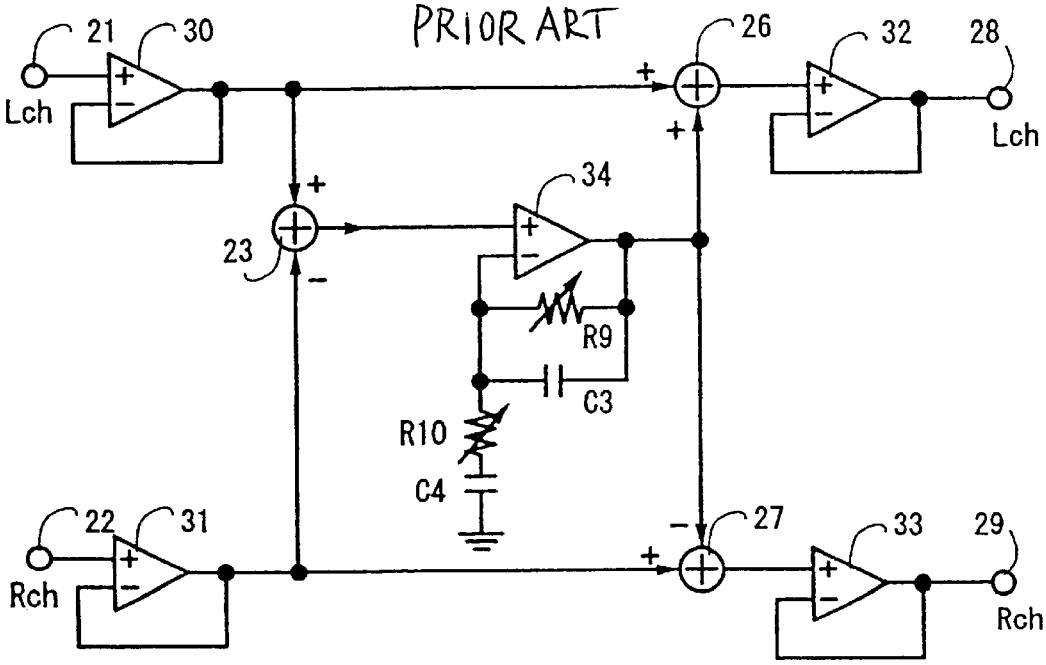
FIG. 10 PRIOR ART
FIG. 10 is a circuit diagram of another conventional surround reproducing circuit.

FIG. 7 is a block diagram showing a surround reproducing circuit according to a third embodiment of the present invention. An amplifier 16 is inserted between the phase-shifting circuit 14 and the buffer 10 in the surround reproducing circuit according to the second embodiment shown in FIG. 4 and the amplifier 16 is caused to have a gain of 3 dB or more. As a result, a gain difference of 3 dB or more is made within a full frequency band between both channels. Consequently, even if an interval between speakers is smaller, for example, 20 cm or less, a desirable surround effect can be produced.

The amplifier 16 can also be inserted between the adder 8 and the phase-shifting circuit 14 or between the adder 9 and the buffer 11 on the R channel side. Moreover, an attenuator having an attenuation factor of 3 dB or more can also be inserted in place of the amplifier 16. In any case, the same effects can be obtained.

According to the present invention, as described above, middle-pass and high-pass frequency components of the difference signal component of the L signal and the R signal are attenuated by means of the low-pass filter. As compared with the case in which a conventional band-elimination filter is used, therefore, a change in a phase is lessened within a frequency band of 20 Hz to 20 KHz and the localization can become definite, and furthermore, a harsh high pass is also lessened. Consequently, it is possible to realize a surround effect having natural spread. Furthermore, the number of capacitors to be required can also be decreased.

Moreover, the phase-shifting circuit having such a characteristic that a gain is almost constant within the full frequency range and a phase is changed from 0 to 180 degrees according to an increase in a frequency is inserted in one of the channels. Also in the case in which the interval between the speakers is small, for example, approximately 20 cm, consequently, the surround signals added in opposite phases to each other can be prevented from being offset in a space.

By inserting an amplifier or an attenuator in one of the channels to have a gain difference of 3 dB or more between the channels, furthermore, it is possible to produce an excellent surround effect even if the interval between the speakers is 20 cm or less.

What is claimed is:

1. A surround reproducing circuit comprising a first adder for generating a difference signal of an L signal and an R signal which are inputted, a low-pass filter connected to an output side of the first adder, and second and third adders for mixing an output signal of the low-pass filter as a surround signal with the L signal and the R signal in an opposite phase relationship to each other wherein a phase-shifting circuit having an almost constant gain in a full frequency band of the input signal and serving to carry out a phase shift for a change from 0 to 180 degrees according to an increase in a frequency of the input signal is connected to an output side of the second or third adder.

2. The surround reproducing circuit of claim 1, wherein an amplifier or an attenuator is connected to the output side of the second or third adder and a gain difference between a channel of the L signal and a channel of the R signal is set to be 3 dB or more.

3. The surround reproducing circuit of claim 2, wherein the low-pass filter has a cut-off frequency of 700 Hz to 2 KHz and an attenuation characteristic of −6 dB/oct.

4. The surround reproducing circuit of claim 2, wherein a gain variable amplifier is inserted into an output side of the low-pass filter and an output signal of the gain variable amplifier is inputted to the second and third adders in an opposite phase relationship to each other.

5. The surround reproducing circuit of claim 2, wherein the phase-shifting circuit is replaced with a phase-shifting circuit having an almost constant gain within a full-frequency band of the input signal and serving to carry out a phase shift for a change from 90 to 175 degrees within a frequency band of 300 Hz to 3.5 KHz.

6. The surround reproducing circuit of claim 2, wherein the phase-shifting circuit is replaced with a phase-shifting circuit having an almost constant gain within a full-frequency band of the input signal and serving to carry out a phase shift from 120 to 170 degrees at a frequency of 1 KHz.

7. The surround reproducing circuit of claim 1, wherein the phase-shifting circuit is replaced with a phase-shifting circuit having an almost constant gain within a full-frequency band of the input signal and serving to carry out a phase shift for a change from 90 to 175 degrees within a frequency band of 300 Hz to 3.5 KHz.

8. The surround reproducing circuit of claim 1, wherein the phase-shifting circuit is replaced with a phase-shifting circuit having an almost constant gain within a full-frequency band of the input signal and serving to carry out a phase shift from 120 to 170 degrees at a frequency of 1 KHz.

9. The surround reproducing circuit of claim 1, wherein the low-pass filter has a cut-off frequency of 700 Hz to 2 KHz and an attenuation characteristic of −6 dB/oct.

10. The surround reproducing circuit of claim 1, wherein a gain variable amplifier is inserted into an output side of the low-pass filter and an output signal of the gain variable amplifier is inputted to the second and third adders in an opposite phase relationship to each other.

11. A surround reproducing circuit comprising a first adder for generating a difference signal of an L signal and an R signal which are inputted, a low-pass filter connected to an output side of the first adder, and second and third adders for mixing an output signal of the low-pass filter as a surround signal with the L signal and the R signal in an opposite phase relationship to each other wherein the low-pass filter has a cut-off frequency of 700 Hz to 2 KHz and an attenuation characteristic of −6 dB/oct.

12. A surround reproducing circuit comprising a first adder for generating a difference signal of an L signal and an R signal which are inputted, a low-pass filter connected to an output side of the first adder, and second and third adders for mixing an output signal of the low-pass filter as a surround signal with the L signal and the R signal in an opposite phase relationship to each other wherein a gain variable amplifier is inserted into an output side of the low-pass filter and an output signal of the gain variable amplifier is inputted to the second and third adders in an opposite phase relationship to each other.

* * * * *